US011383152B2

(12) United States Patent
Rainwater

(10) Patent No.: US 11,383,152 B2
(45) Date of Patent: Jul. 12, 2022

(54) APPARATUS FOR DISPLAYING AND SUPPORTING POOL CUES

(71) Applicant: Mary Louise Rainwater, Lancaster, CA (US)

(72) Inventor: Mary Louise Rainwater, Lancaster, CA (US)

( * ) Notice: Subject to any disclaimer, the term of this patent is extended or adjusted under 35 U.S.C. 154(b) by 0 days.

(21) Appl. No.: 17/107,364

(22) Filed: Nov. 30, 2020

(65) Prior Publication Data

US 2021/0077895 A1 Mar. 18, 2021

Related U.S. Application Data

(63) Continuation-in-part of application No. 13/999,472, filed on Feb. 28, 2014, now Pat. No. 10,857,447.

(60) Provisional application No. 61/851,099, filed on Feb. 28, 2013.

(51) Int. Cl.

| | |
|---|---|
| ***A47F 7/00*** | (2006.01) |
| ***A63D 15/00*** | (2006.01) |
| ***A63D 15/10*** | (2006.01) |
| ***F21V 33/00*** | (2006.01) |
| *F21W 121/00* | (2006.01) |

(52) U.S. Cl.

CPC ..... *A63D 15/10* (2013.01); *A47F 7/0028* (2013.01); *A63D 15/00* (2013.01); *F21V 33/008* (2013.01); *F21W 2121/00* (2013.01)

(58) Field of Classification Search

CPC ..... A63D 15/10; A63D 15/00; F21V 33/008; A47F 7/0028

See application file for complete search history.

(56) References Cited

U.S. PATENT DOCUMENTS

| | | | | |
|---|---|---|---|---|
| 173,816 A | | 2/1876 | Rising | |
| 478,213 A | | 7/1892 | Fuchs | |
| 636,257 A | * | 11/1899 | Gibbon et al. | A63D 15/00 473/20 |
| 1,127,318 A | | 2/1915 | Thomas | |
| 1,478,043 A | | 7/1921 | Matteson | |

(Continued)

FOREIGN PATENT DOCUMENTS

CN 106807053 A 6/2017

OTHER PUBLICATIONS

Keurek 8-Ball, downloaded from http://poolbiljart.nl/aanbiedingen.html on Aug. 28, 2020.

(Continued)

*Primary Examiner* — Kimberley S Wright

(74) *Attorney, Agent, or Firm* — Manning & Kass, Ellrod, Ramirez, Trester LLP; Roland J. Tong

(57) ABSTRACT

A pool cue holder includes a housing having a set of four, circumferentially spaced-apart openings configured to receive the distal end of a pool cue. The dimension, position, and shape of the openings are selected such that when the proximal end of each pool cue is positioned in a different corner of a pool table and the corresponding distal end of each pool cue is inserted through a different one of the one of the four openings in the housing, the housing will be supported directly over the center of the pool table. A receptacle containing a light source may be secured to the bottom of the housing. The bottom wall of the receptacle may have cut-outs arranged in a decorative pattern that allows light from the light source to illuminate the pool table in an interesting fashion.

18 Claims, 4 Drawing Sheets

(56) References Cited

U.S. PATENT DOCUMENTS

| | | | | |
|---|---|---|---|---|
| 2,221,704 | A | 10/1939 | Farley | |
| 2,489,464 | A | 11/1946 | Roland | |
| 3,650,384 | A * | 3/1972 | Pegg | A47F 5/0025 211/1 |
| 4,002,241 | A | 1/1977 | Parilla, Sr. | |
| 4,029,313 | A | 6/1977 | Angulo | |
| D308,610 | S | 6/1990 | Ianni | |
| 5,071,048 | A | 12/1991 | Price et al. | |
| 5,355,541 | A * | 10/1994 | Rutter | D06F 39/024 8/158 |
| D367,408 | S | 2/1996 | Fordyce et al. | |
| 5,690,235 | A | 11/1997 | Matzen | |
| D422,439 | S | 4/2000 | Chen | |
| 6,168,030 | B1 | 6/2001 | Morris | |
| 6,419,588 | B1 | 7/2002 | Watlack | |
| 6,505,747 | B1 * | 1/2003 | Robertson | A47F 7/283 211/194 |
| 6,537,156 | B1 | 3/2003 | Stagg | |
| 6,629,897 | B2 | 10/2003 | Belknap | |
| 6,926,152 | B2 | 8/2005 | Leung | |
| 6,945,413 | B1 | 9/2005 | Meyer | |
| 8,033,679 | B1 * | 10/2011 | Kemmler | A47B 97/00 362/125 |
| 8,656,547 | B2 * | 2/2014 | Zanetti | A47L 25/00 15/210.1 |
| 8,936,386 | B2 | 1/2015 | Yang | |
| D728,694 | S | 5/2015 | Nelson et al. | |
| 10,124,240 | B2 | 11/2018 | Parvant | |
| 10,619,799 | B1 | 4/2020 | Phillip | |
| 10,641,440 | B2 | 5/2020 | Chien et al. | |
| 2002/0185388 | A1 | 12/2002 | Su | |
| 2003/0234230 | A1 | 12/2003 | Wang | |
| 2004/0132535 | A1 | 7/2004 | Sumko | |
| 2006/0009300 | A1 | 1/2006 | Gumersindo | |
| 2006/0144806 | A1 | 7/2006 | Joannou | |
| 2007/0039911 | A1 | 2/2007 | Sator | |
| 2009/0308822 | A1 | 12/2009 | Byers | |
| 2012/0084929 | A1 * | 4/2012 | Zanetti | A63D 15/105 15/1.52 |
| 2012/0091019 | A1 | 4/2012 | Lin | |
| 2016/0023090 | A1 | 1/2016 | Rainwater | |
| 2016/0238199 | A1 | 8/2016 | Yeung et al. | |
| 2019/0039510 | A1 | 2/2019 | Chen et al. | |

OTHER PUBLICATIONS

Christmas Projector Lights, downloaded from https://bit.ly/3oZEQ5j on Sep. 10, 2020.

* cited by examiner

APPARATUS FOR DISPLAYING AND SUPPORTING POOL CUES

CROSS-REFERENCE TO RELATED APPLICATIONS

This application is a continuation-in-part of U.S. patent application Ser. No. 13/999,472, filed Feb. 28, 2014, which claims the benefit of U.S. provisional patent application No. 61/851,099, filed Feb. 28, 2013, the contents of which are incorporated herein by reference.

BACKGROUND OF THE INVENTION

1. Field of the Invention

The present invention relates to pool tables, and more particularly, to an apparatus for displaying pool cues and a pool ball on a pool table, while simultaneously illuminating the pool table.

2. Background Art

It is estimated that there are approximately between 1.75 and 3 million home pool tables in the United States alone. This estimate is based on the number of pool tables sold annually in the United States, and may not include tables include in establishments such as bars, taverns, and recreation centers.

Most pool tables are covered when not in use, and accessories such as cues and balls may be stored on separate tables, wall-mounted racks, canopies above the table, or various other fixtures. While many of these fixtures are adequate for their purposes, they are rather plain in design and do not accentuate or complement the elegance of the pool table. This and other shortcomings of existing pool cue holders are addressed by the present disclosure as discussed below.

SUMMARY OF THE INVENTION

A pool cue holder according to the present disclosure includes a housing having a set of four, circumferentially spaced-apart openings configured to receive the distal end of a pool cue. The dimension, position, and shape of the openings are selected such that when the proximal end of each pool cue is positioned in a different corner of the a table and the corresponding distal end of each pool cue is inserted through a different one of the one of the four openings in the housing, the housing will be supported directly over the center of the pool table. Thus, the housing and the cues together form an eye-pleasing and inviting teepee-like structure that draws the viewer's attention.

In one aspect of the invention, the housing has the shape of a truncated dome, and the openings are formed in a curved side wall having a circular bottom edge. The dome includes a top wall having a circular indentation configured to receive and support a pool ball.

In another aspect of the invention, the interior portion of the housing includes a plurality of radially extending, circumferentially spaced-apart partitions, each partition defining a side of a chamber configured to receive a pool cue. Each partition may extend at an oblique angle to an adjacent partition so that each chamber defined by the two adjacent partition is pie-shaped, with an apex that is narrower in width than the distal end of a pool cue. The partitions may be six in number.

In another aspect of the invention, each opening may be located between two adjacent partitions. The openings may be oval in shape, with a width that is wider than the distal end of a pool cube, and a length that is at least one and a half times as large as the width.

In some embodiments, the bottom end of the housing may be open. One or more small LED light sources may be placed in the inner surface of the side wall, to illuminate the pool table when the cues are not in use. A hook may be provided on the underside of the top wall of the housing to allow users to hang decorative items below the housing.

In some embodiments, a base receptacle having a side wall and a bottom wall may be secured to the bottom end of the housing. The base receptacle may contain an LED light, and the bottom wall may include openings allowing light from the LED light source to illuminate the table. The openings may be arranged in a manner allowing the light to illuminate the table in and interesting and decorative way. In one embodiment, the openings may be arranged in a stars and stripes pattern.

DETAILED DESCRIPTION

Figure 1:
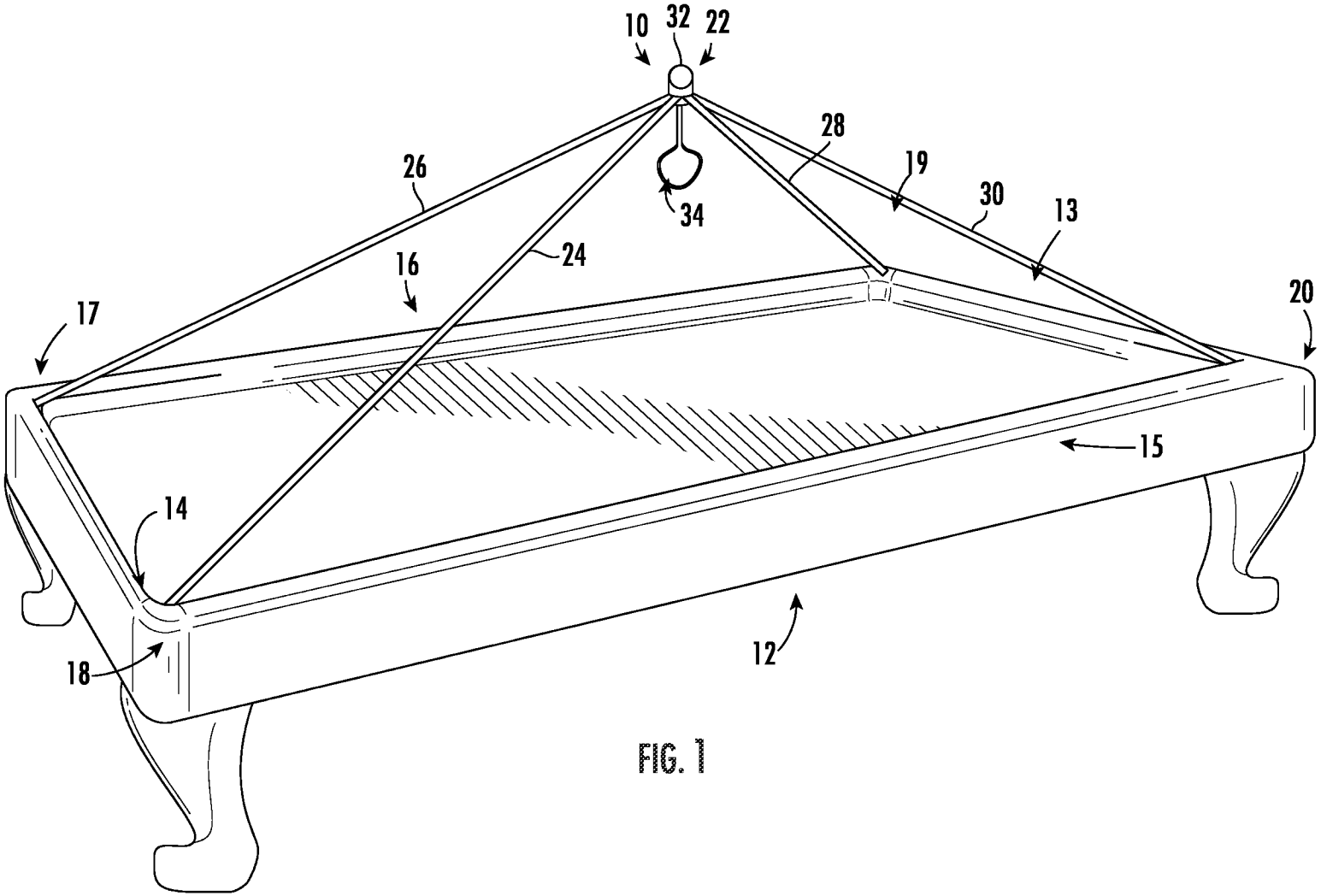
FIG. 1 is a perspective view showing a cue holder supported above a pool table.

With reference to FIG. 1, a cue holder 10 according to the present disclosure is shown supported above a pool table 12 having two short sides 13, 14, two long sides 15, 16, and four corners 17, 18, 19, 20. The pool table 12 may be any standard size. For instance, it may be a seven foot table measuring 7' by 3', an eight foot table measuring 8' by 3.5', or a nine foot table measuring 9' by 4'.

The cue holder 10 includes a housing 22 that receives the distal ends of four pool cues 24, 26, 28, 30, the proximal ends of which are received in the corners 17, 18, 19, 20. The cues may be any standard size. For instance, they may measure 48, 52, or 58" in length. Each cue is tapered, with a distal end having a smaller diameter than its proximal end. A ball, preferably a regulation cue ball 32 having a diameter of 2¼", is mounted on top of the housing 20, and an ornament 34 is hung from the bottom of the housing 22.

Figure 2:
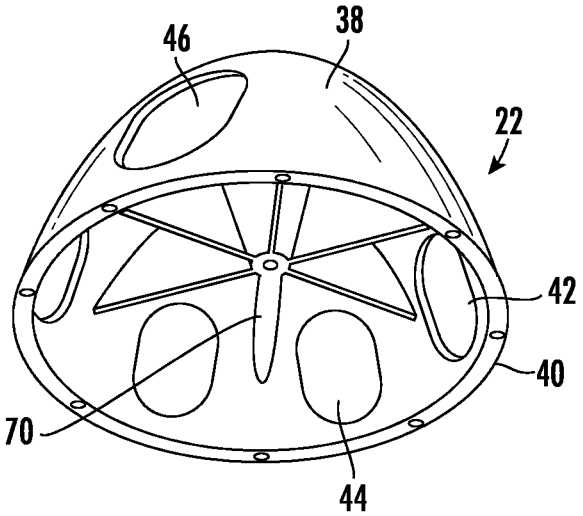
FIG. 2 is a perspective view taken from the front and bottom of a cue holder housing.
Figure 3:
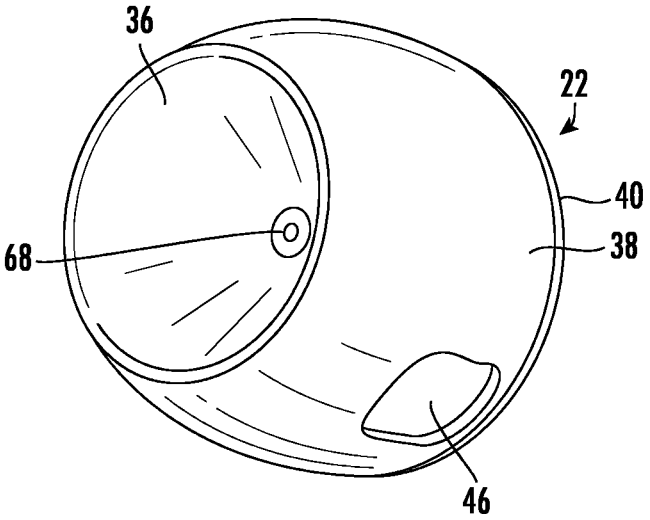
FIG. 3 is perspective view taken from the front and top of the cue holder housing of FIG. 2.
Figure 4:
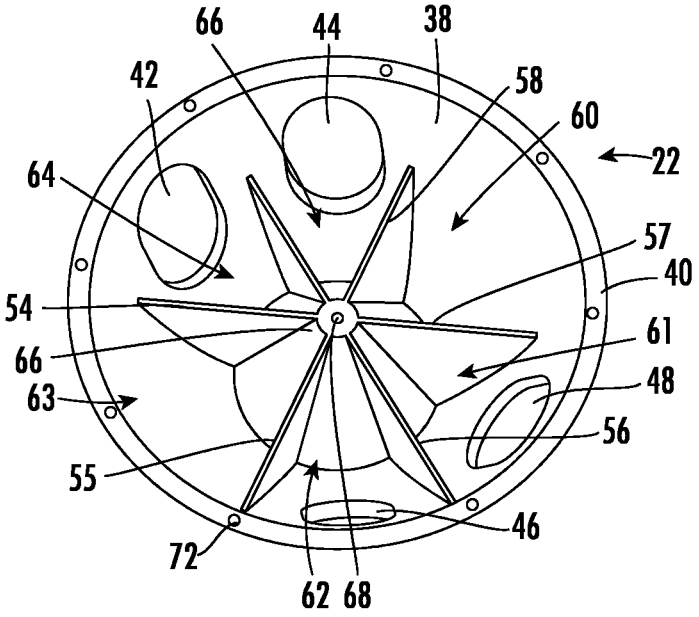
FIG. 4 is a bottom view of the cue holder housing of FIGS. 2 and 3.

The housing 22, best seen in FIGS. 2-4, is a truncated dome-shaped structure including a top wall 36 and a curved side wall 38 having a circular bottom edge 40. The top wall 36 defines a hemispherical indentation having a diameter approximately equal to the diameter of a cue ball. A set of four openings 42, 44, 46, 48 for receiving the ends of the cues is formed in the side wall 38. The openings are not evenly spaced around the circumference of the housing 2; rather, two openings 42, 44 are located on one side of the housing 22 facing one of the short sides of the pool table, and the other two openings 46, 48 are located on the opposite side of the housing facing the other short side of the pool table. The dimensions, position, and shape of the openings are selected such that when the proximal end of each cue is positioned in one of the corners of the pool table 12 and the corresponding distal end of each pool cue is inserted through a different one of the one of the four openings 42, 44, 46, 48, the cue holder 22 will be supported directly over the center of the pool table 12. Each opening may be generally oval. The width of each opening must be greater than the diameter of the distal end of a cue, and less than the diameter of the proximal end of a cue. The length of each opening should be at least one and a half times the width of the opening. This arrangement and configuration of openings allows the cues to form a teepee-like configuration when inserted into the housing 22. If the table and/or cues are short (for instance, a 7' foot long table and/or 48" inch long cues), the height of the "teepee" (ie. the distance between the pool table and the housing) will be relatively low and the distal ends of the cues will be supported in or near the bottom of each opening 42, 44, 46, 48. If the table and/or cues are long, (for instance, a 9' foot long table and/or 58" inch long cues), the height of the "teepee" is greater, and the distal ends of the cues will be supported near the top of each opening.

As best seen in FIG. 4, the interior portion of the housing includes a plurality of radially extending, circumferentially spaced-apart partitions 54, 55, 56, 57, 58 that divide the interior into pie-shaped chambers 60, 61, 62, 63, 64, 65. Four of the chambers 61, 62, 64, 65 are relatively narrow and are each aligned with a different one of the openings 42, 44, 46, 48. Each of these narrow chambers 62, 62, 64, 65 has an apex that is narrow enough to securely retain a cue inserted through the corresponding opening. The remaining chambers 60, 63 are not aligned with any openings and may be wider than the narrow chambers 61, 62, 64, 65. In the embodiment shown, there are six partitions defining six chambers. The partitions defining the sides of the narrow chambers 61, 62, 64, 65 extend at an angle of approximately 50° to one another, while the partitions defining the sides of the remaining chambers 60, 63 extend at an angle of approximately 80° to one another.

The partitions 54, 55, 56, 57, 58 intersect a central hub 66 in the center of the housing 22. A hole 68 formed in the hub 66 allows the attachment of a hook 70, as shown in FIG. 2. The hook 70 may be used to suspend decorative items such as the ornament shown in FIG. 1 from the housing 22. In some embodiments, one or more small LED lights may also be embedded in the interior of side wall 38 to illuminate the ornament and/or the pool table itself.

Returning to FIG. 4, the bottom edge 40 of the side wall 38 may be provided with a plurality of small holes 72 for receiving fasteners to allow the housing 22 to be detached to a base receptacle, as will now be discussed with reference to FIGS. 5-7.

Figure 5:
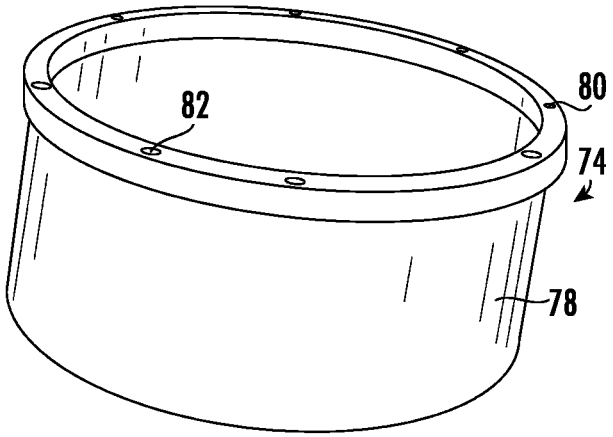
FIG. 5 is a perspective view taken from the front and top of a base receptacle attachable to the cue holder housing of FIGS. 2-4.
Figure 6:
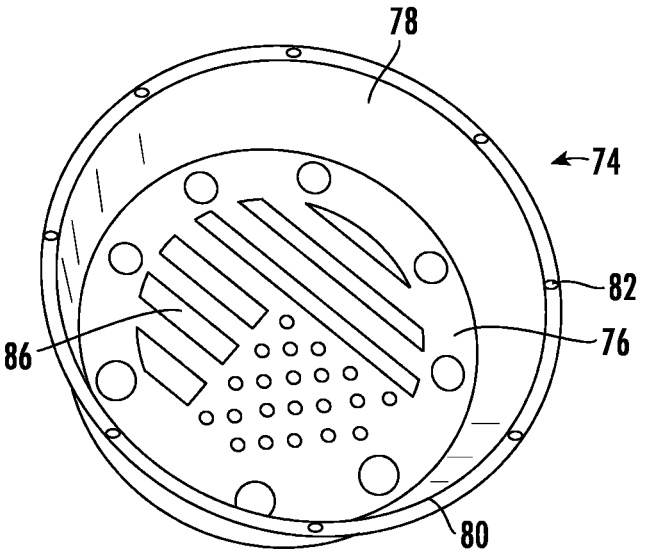
FIG. 6 is a bottom view of the receptacle shown in FIG. 5.
Figure 7:
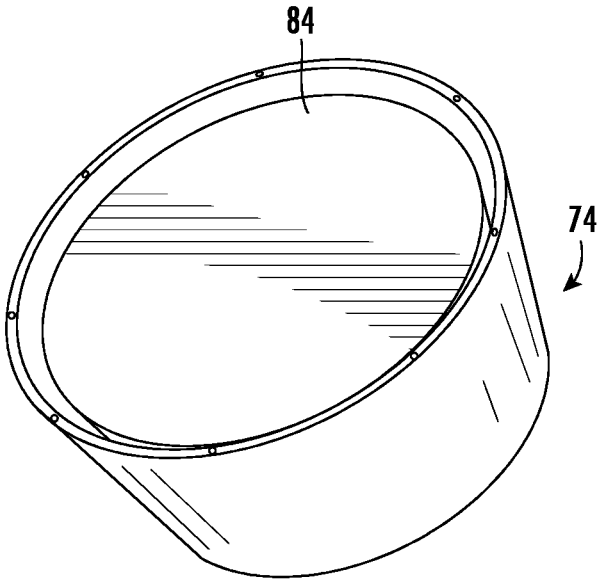
FIG. 7 is a perspective view taken from the front and bottom, showing the receptacle of FIG. 5 containing a light source.

The base receptacle, identified in FIGS. 5-7 by the reference numeral 74, is cylindrical in structure, and includes a bottom wall 76 and a curved side wall 78 having a circular top edge 80. A plurality of small holes 82 may be formed in the top edge 80. These holes may be aligned with the holes in the bottom edge of the side wall of the housing of the cue holder, and may receive fasteners such as screws or pins that detachably secure the base receptacle 74 to the housing. A light source such as an LED light 84 may be mounted in the base receptacle 74. A plurality of cut-outs 86 provided in the bottom wall 76 of the base receptacle 74 allow light from the light source 84 to travel out of the receptacle to illuminate the table. The cut-outs may be arranged in a decorative pattern such as the stars and stripe pattern shown, thus creating an interesting and attractive interplay of light and shadow on the surface of the pool table.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An apparatus for displaying and supporting a set of four pool cues on a pool table having a center and four corners, each pool cue having a proximal end having first diameter and a distal end having a second diameter smaller than the first diameter, the apparatus comprising:

a housing having the shape of a truncated dome, the housing including a top wall including an exterior side having a center, and an interior side having a center, a curved side wall including an exterior side, an interior side, and a circular bottom edge; and a set of four circumferentially spaced-apart openings extending through the exterior and interior sides of the curved side wall, each opening being alignable with a different one of the corners and having a width and height greater than the second diameter;

wherein the dimensions, position, and shape of the openings are selected such that when the proximal end of each pool cue is positioned in a different corner of the pool table and the corresponding distal end of each pool cue is inserted through a different one of the one of the four openings in the housing, the housing will be supported directly over the center of the pool table; and a base receptacle detachably secured to the bottom edge of the curved side wall, the base receptacle including a curved side wall with a circular top edge; and a bottom wall.

2. The apparatus according to claim 1, wherein the housing further comprises a hemispherical indentation formed in the center of the exterior side of the top wall, and configured to receive and support a pool ball.

3. The apparatus according to claim 1, wherein the dimensions of each opening are sufficient to allow the opening to receive and retain the distal end of one of the pool cues when the apparatus is positioned over the center of the table and the proximal end of the pool cue is positioned in a corner of the pool table, for various standard sizes of pool tables.

4. The apparatus according to claim 1, wherein each opening is oval.

5. The apparatus according to claim 4, wherein each opening has a width and a length, wherein the width of the opening is greater than the second diameter, and the length of the opening is at least one and a half times the width of the opening.

6. The apparatus according to claim 1, further comprising a light source mounted in the base receptacle.

7. The apparatus according to claim 6, wherein the light source is removably mounted in the base receptacle.

8. The apparatus according to claim 6, wherein the bottom wall defines an opening allowing light from the light source to illuminate the table.

9. The apparatus according to claim 6, wherein, the bottom wall defines a plurality of cut-outs arranged to allow light emitted from the light source to illuminate the table in a decorative way.

10. The apparatus according to claim 9, wherein in the openings are arranged in a stars and stripes pattern.

11. An apparatus for displaying and supporting a set of four pool cues on a pool table having a center and four corners, each pool cue having a proximal end having first diameter and a distal end having a second diameter smaller than the first diameter, the apparatus comprising:

a housing including a top wall and a side wall, the side wall defining a set of four circumferentially spaced-apart openings, each opening being alignable with a different one of the corners and having a width and height greater than the second diameter;

wherein the dimensions, position, and shape of the openings are selected such that when the proximal end of each pool cue is positioned in a different corner of the pool table and the corresponding distal end of each pool cue is inserted through a different one of the one of the four openings in the housing, the housing will be supported directly over the center of the pool table; and a base receptacle secured to a bottom edge of the housing, the base receptacle having a bottom wall; and a light source contained within the base receptacle, wherein the bottom wall of the base receptacle defines a plurality of openings arranged to allow light emitted from the light source to illuminate the table in a decorative way.

12. The apparatus according to claim 11, wherein:

the housing has the shape of a truncated dome; and the side wall is curved and includes a circular bottom edge.

13. The apparatus according to claim 12, wherein:

the top wall has an exterior side and an interior side; and the housing further comprises a hemispherical indentation formed in exterior side of the top wall, and configured to receive and support a pool ball.

14. An apparatus for displaying and supporting a set of four pool cues on a pool table having a center and four corners, each pool cue having a proximal end having first diameter and a distal end having a second diameter smaller than the first diameter, the apparatus comprising:

a housing having the shape of a truncated dome, the housing including a top wall including an exterior side having a center, and an interior side having a center, a curved side wall including an exterior side, an interior side, and a circular bottom edge;

a set of four circumferentially spaced-apart openings extending through the exterior and interior sides of the curved side wall, each opening being alignable with a different one of the corners and having a width and height greater than the second diameter; and a plurality of radially extending, circumferentially spaced-apart partitions, each partition defining a side of a chamber configured to receive a pool cue;

wherein the dimensions, position, and shape of the openings are selected such that when the proximal end of each pool cue is positioned in a different corner of the pool table and the corresponding distal end of each pool cue is inserted through a different one of the one of the four openings in the housing, the housing will be supported directly over the center of the pool table.

15. The apparatus according to claim 14, wherein each opening is located between two adjacent partitions.

16. The apparatus according to claim 14, wherein each partition extends at an oblique angle to an adjacent partition to define a pie-shaped chamber having a narrow apex with a width less than the second diameter.

17. The apparatus according to claim 14, comprising six partitions.

18. An apparatus for displaying and supporting a set of four pool cues on a pool table having a center and four corners, each pool cue having a proximal end having first diameter and a distal end having a second diameter smaller than the first diameter, the apparatus comprising:

a housing including a top wall, a side wall, the side wall defining a set of four circumferentially spaced-apart openings, each opening being alignable with a different one of the corners and having a width and height greater than the second diameter, and a plurality of radially extending, circumferentially spaced-apart partitions, each partition defining a side of a chamber configured to receive a pool cue, wherein the dimensions, position, and shape of the openings are selected such that when the proximal end of each pool cue is positioned in a different corner of the pool table and the corresponding distal end of each pool cue is inserted through a different one of the one of the four openings in the housing, the housing will be supported directly over the center of the pool table.

* * * * *